US005579630A

United States Patent [19]

Inverardi

[11] Patent Number: 5,579,630

[45] Date of Patent: Dec. 3, 1996

[54] DEVICE FOR ELIMINATING THE YARN RESERVE WOUND ON SPINNING OR TWISTING MACHINE SPINDLES

[75] Inventor: Dante Inverardi, Cologne, Italy

[73] Assignee: Fratelli Marzoli & C. S.p.A., Italy

[21] Appl. No.: 504,474

[22] Filed: Jul. 20, 1995

[30] Foreign Application Priority Data

Jul. 25, 1994 [IT] Italy ..... MI940543 U

[51] Int. Cl.[6] ..... D01H 5/28; D01H 11/00

[52] U.S. Cl. ..... 57/305; 57/299; 57/303; 57/306; 242/18 EW; 242/18 PW

[58] Field of Search ..... 57/303, 304, 305, 57/299, 306; 242/19, 18 PW, 18 EW

[56] References Cited

U.S. PATENT DOCUMENTS

| | | | |
|---|---|---|---|
| 3,312,051 | 4/1967 | Schumann et al. | 57/304 |
| 3,665,694 | 5/1972 | Ford et al. | 57/304 |
| 4,133,168 | 1/1979 | Keller, Jr. et al. | 57/304 |
| 4,208,865 | 6/1980 | Koella | 57/303 |
| 4,283,909 | 8/1981 | Keller et al. | 57/306 |
| 4,484,434 | 11/1984 | Rummele | 57/304 |
| 4,936,086 | 6/1990 | Carter et al. | 57/304 |
| 4,942,730 | 7/1990 | Morrison | 242/18 EW |

FOREIGN PATENT DOCUMENTS

| | | | |
|---|---|---|---|
| 0251397 | 6/1987 | European Pat. Off. . | |
| 0394885 | 4/1990 | European Pat. Off. . | |
| 0421151 | 9/1990 | European Pat. Off. . | |
| 0421714 | 10/1990 | European Pat. Off. . | |
| 1266192 | 10/1964 | Germany . | |
| 3305960 | 8/1984 | Germany | 57/303 |
| 4140049 | 12/1991 | Germany . | |
| 1230309 | 7/1989 | Italy . | |
| 47431 | 3/1984 | Japan | 57/303 |
| 11128 | 3/1985 | Japan | 57/303 |

*Primary Examiner*—William Stryjewski
*Attorney, Agent, or Firm*—Diller, Ramik & Wight, PC

[57] ABSTRACT

The improved device (1A, 1B) for removing the yarn reserve (15) wound on the spindles (13) of spinning or twisting machines (2), is of the type traversing on rails (3) positioned above and along the spinning or twisting machine (2) so as not to impede work carried out manually on the spindle frame. Moreover, so as to be particularly effective in removing yarn reserves (15) and dust, the brush (12) is circular in plan, it rotates about itself (12) and is housed partly within the suction port (11) such as to project by the amount sufficient for operation (FIG. 2).

13 Claims, 5 Drawing Sheets

DEVICE FOR ELIMINATING THE YARN RESERVE WOUND ON SPINNING OR TWISTING MACHINE SPINDLES

BACKGROUND OF THE INVENTION

This invention relates to a unit for removing the yarn reserve from spinning or twisting machine spindles which represents substantially an improvement on the device described in Italian industrial invention patent No. 1230309.

The device described in said prior patent provides for removing the yarn reserve by means of a pair of brushes and a suction port positioned in proximity to said brushes. The first brush cuts that yarn portion extending between the spindle and the yarn reserve, whereas the second brush momentarily retains the yarn reserve to enable the suction port to remove it. Although this device operates in a substantially satisfactory manner, it requires further improvement to increase its effectiveness particularly with regard to the dust which is generated during the removal of the yarn reserve.

SUMMARY OF THE INVENTION

The object of the present invention is therefore to provide a device of greater effectiveness both in removing the yarn reserve and in removing the dust generated during said operation.

The effect of the rotation of the yarn reserve removing brush and its position relative to the suction port results in the yarn reserve, during its removal, being also subjected to a centrifugal force which removes it from the brush which has withdrawn it from the spindle base and projects it directly into the suction port. The dust generated during this operation is substantially subjected to the same suction port. Moreover, because of the rotation, the brush is much less subject to clogging by the yarn reserve. The device therefore operates with particular effectiveness and reliability with regard to clogging.

BRIEF DESCRIPTION OF THE DRAWINGS

The invention is illustrated by way of non-limiting example in the figures of the accompanying drawings.

DESCRIPTION OF THE PREFERRED EMBODIMENTS

Figure 1:
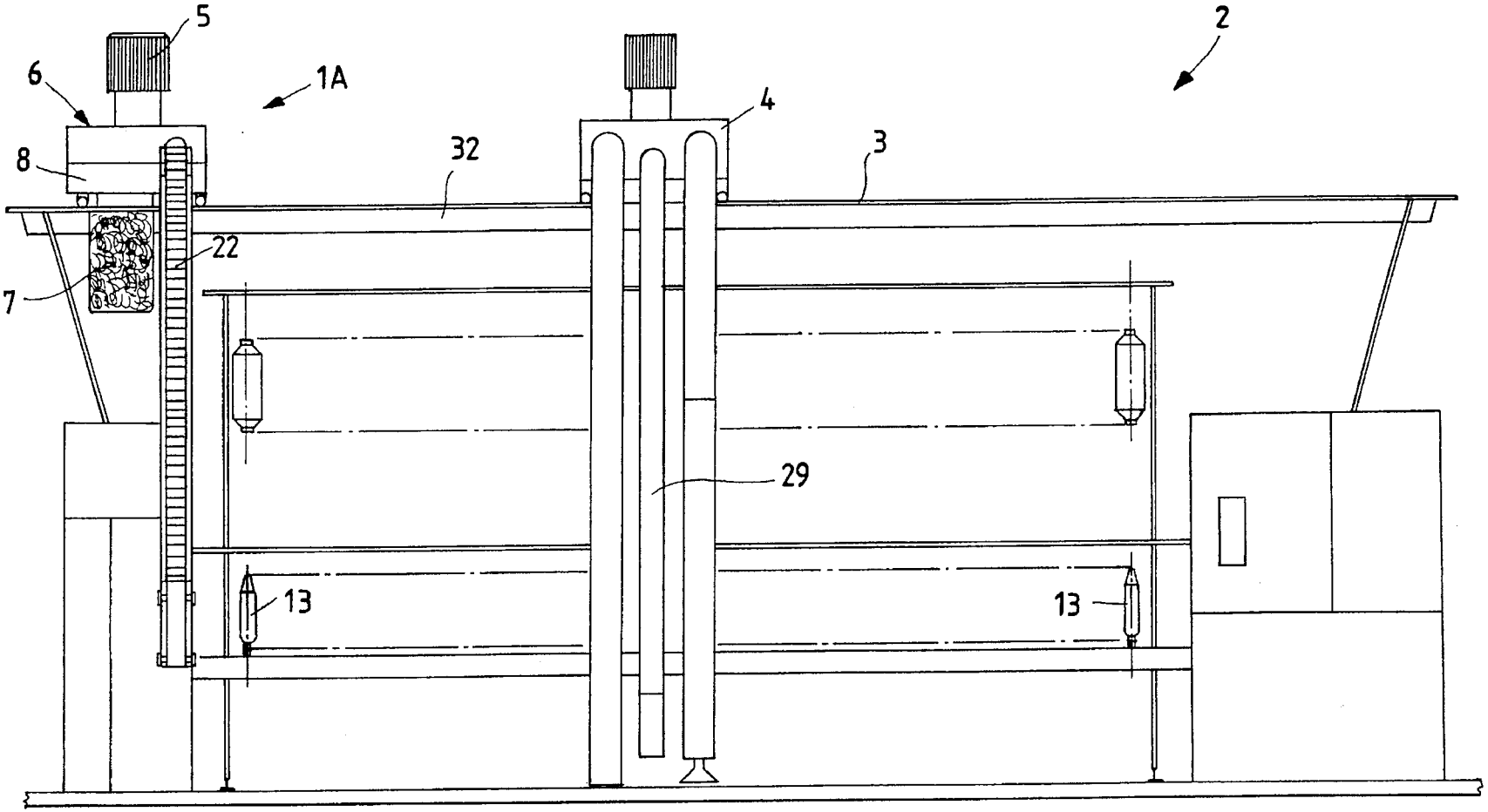
FIG. 1 is a schematic front view of a machine housing a first embodiment of the unit according to the invention.
Figure 2:
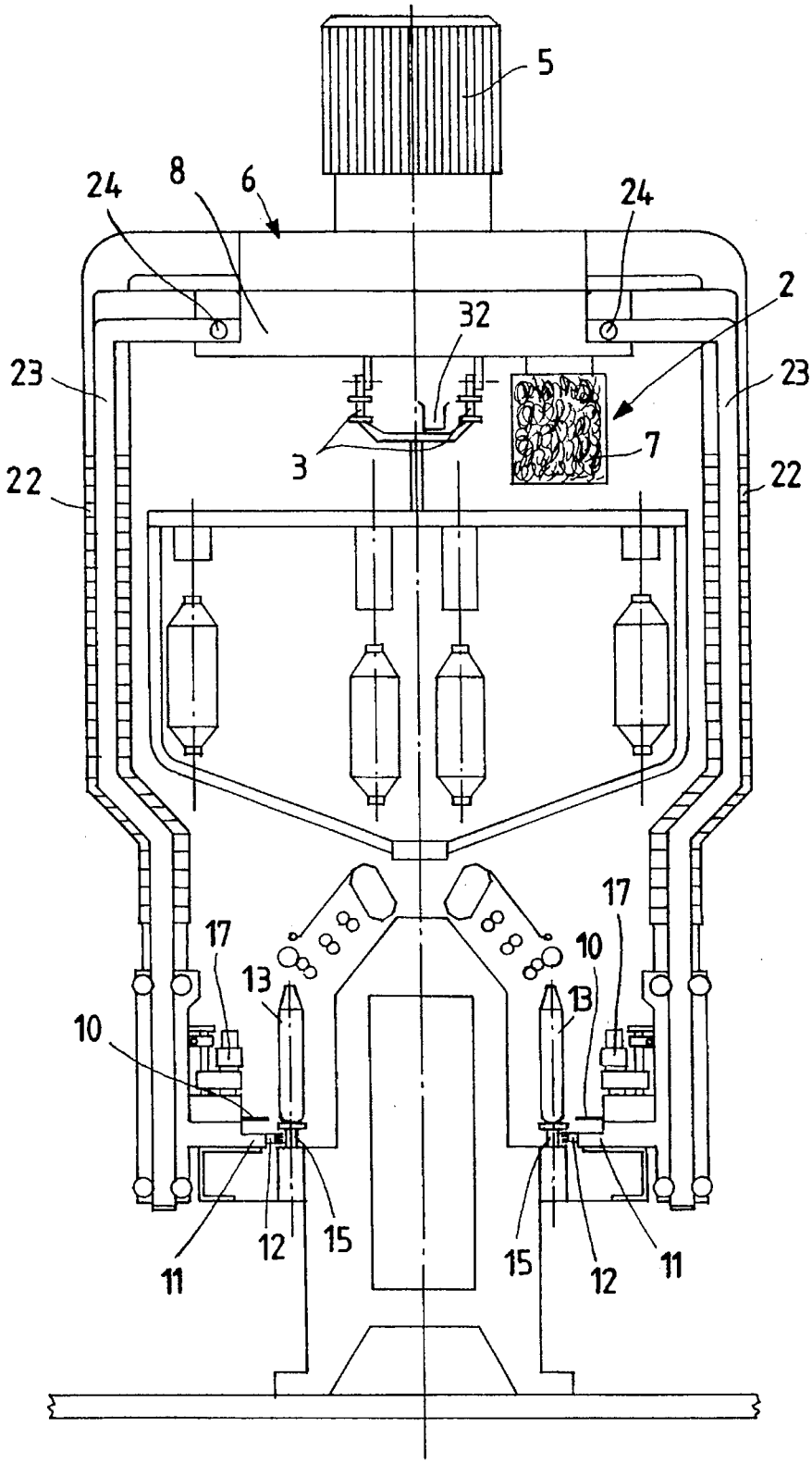
FIG. 2 is a schematic side view of a machine housing the unit of FIG. 1.

With reference to said figures, the unit of the invention is used for removing the yarn reserve from spindles. It therefore operates on spinning or twisting machines such as ring spinning and twisting machines. One of such machines is indicated overall by 2 in said FIGS. 1 and 5.

With particular reference to FIGS. 1–4, the unit of the invention is symmetrical about the textile machine and, in a first embodiment indicated overall by 1A, comprises at least one blade 10 (for each side) arranged to cut the yarn portion (not visible) lying between that wound on the spindle 13 and that forming the yarn reserve 15, a brush 12 (for each side) for removing said yarn reserve 15, a suction device 6 provided with a suction port 11 (for each side), a reduction gear 8, and at least one motor 5 operating the device 6 and the reduction gear 8.

In the illustrated embodiment (see FIG. 4), the unit 1A comprises (for each side) two blades 10 for more reliable yarn cutting.

The brush 12 is circular-in plan, and rotates on itself about a vertical axis 16 by the action of a motor 17. The brush 12 and motor 17 are housed on a swivel-mounted device 18 pivotally mounted at a pivot 38 (FIG. 4) against the bias of a spring 39 to enable the brush 12 to be biased to its optimum position with respect to the base portions of the spindles 13 on which the yarn reserve 15 is wound. According to an important characteristic of the invention, the brush 12 is housed partly within the suction port 11 such as to project by an amount sufficient to achieve the necessary contact with the yarn reserves 15 on each spindle 13.

Consequently, by the effect of the rotation of the brush 12 relative to the suction port 11, the yarn reserve 15, during its removal, is also subjected to a centrifugal force which separates it from the brush 12 which has withdrawn it from the spindle, and projects it directly into the suction port. In practice there is therefore no possibility of the yarn reserve being able to escape the suction effect and becoming dispersed within the surrounding environment. The dust generated during the reserve removal operation is also subjected to the same suction port.

In addition, by the effect of its rotation, the brush 12 is much less subject to clogging by the yarn of the reserve 15, which in previous units tended to knot onto the brush bristles. The unit therefore operates with particular effectiveness and reliability. In order to further increase the suction efficiency of the unit and hence reduce dust dispersion into the environment, to the side of the suction port 11 there are provided two mutually converging nozzles 19 directed towards the outside of said suction port 11 so as to blow air counter-currently (arrows F) to that drawn in (arrow G) by the port 11. The action of said nozzles is to direct the dust towards the inside of the operating area of the suction port. Preferably said blowing nozzles 19 are fed via conduits 31 from the exhaust air of the pneumatic motor 17 which drives the particular rotary brush 12. To further increase the effectiveness of the unit, the rotational speed of the brush 12 is adjustable according to requirements, and in particular to the yarn characteristics.

The unit also comprises a first 20 and a second 21 locator, respectively operating to provide the desired mutual positioning, in both the vertical and horizontal direction, between the spindles 13 of the textile machine 2 and the following unit components: blades 10, rotary brush 12 and suction port 11. The pipe 22 connecting the suction port 11 to the top of the suction device 6 is consequently telescopic in the vertical direction and is supported by an arm 23 connected by a hinge 24 to the reduction gear 8 so as to swivel in a vertical plane.

During operation, the reduction gear 8 drives the entire unit 1A along the textile machine 2, sliding on the rails 3 on which the travelling blower 4 slides. The blades 10 cut the yarn portions connecting the spindles to the relative reserves. The brush 12 removes the yarn reserves without in any way interfering with the spindle, the suction device 6 then drawing in the yarn and dust, which is deposited in a collection container 7. A suitable electrical circuit can control both the unit 1A and the travelling blower 4 such that there is no collision between the two devices. By means of the electrical circuit it is also possible to program a number of consecutive travel strokes of the unit 1A. The electrical feed cables and pneumatic hoses for the two devices are positioned in the channel 32.

Figure 5:
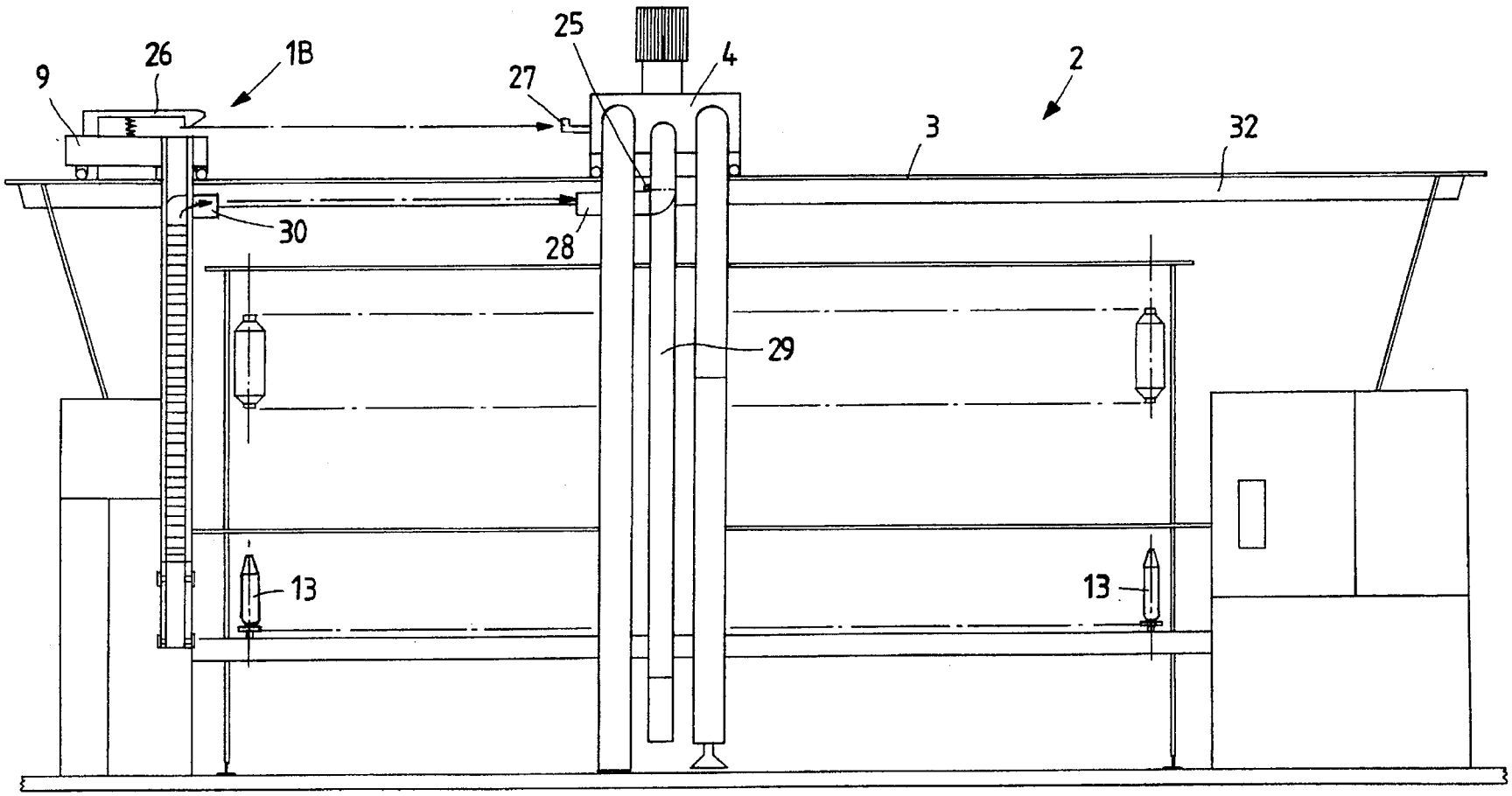
FIG. 5 is a schematic front view of a machine housing a second embodiment of the unit according to the invention.

To reduce costs, the yarn reserve-removal unit according to the invention can be formed in accordance with a second embodiment, indicated overall by 1B in FIG. 5. The unit 1B differs from the unit 1A in that in place of the motor 5, the upper part of the suction device 6, the container 7 and the reduction gear 8, there are provided a carriage 9 slidable idly along the rails 3, means for coupling the unit 1B to the travelling blower 4, and a shut-off valve 25.

The coupling means comprise a pawl 26 rigid with the idle carriage 9 and cooperating with a hook element 27 positioned on the travelling blower 4.

Figure 3:
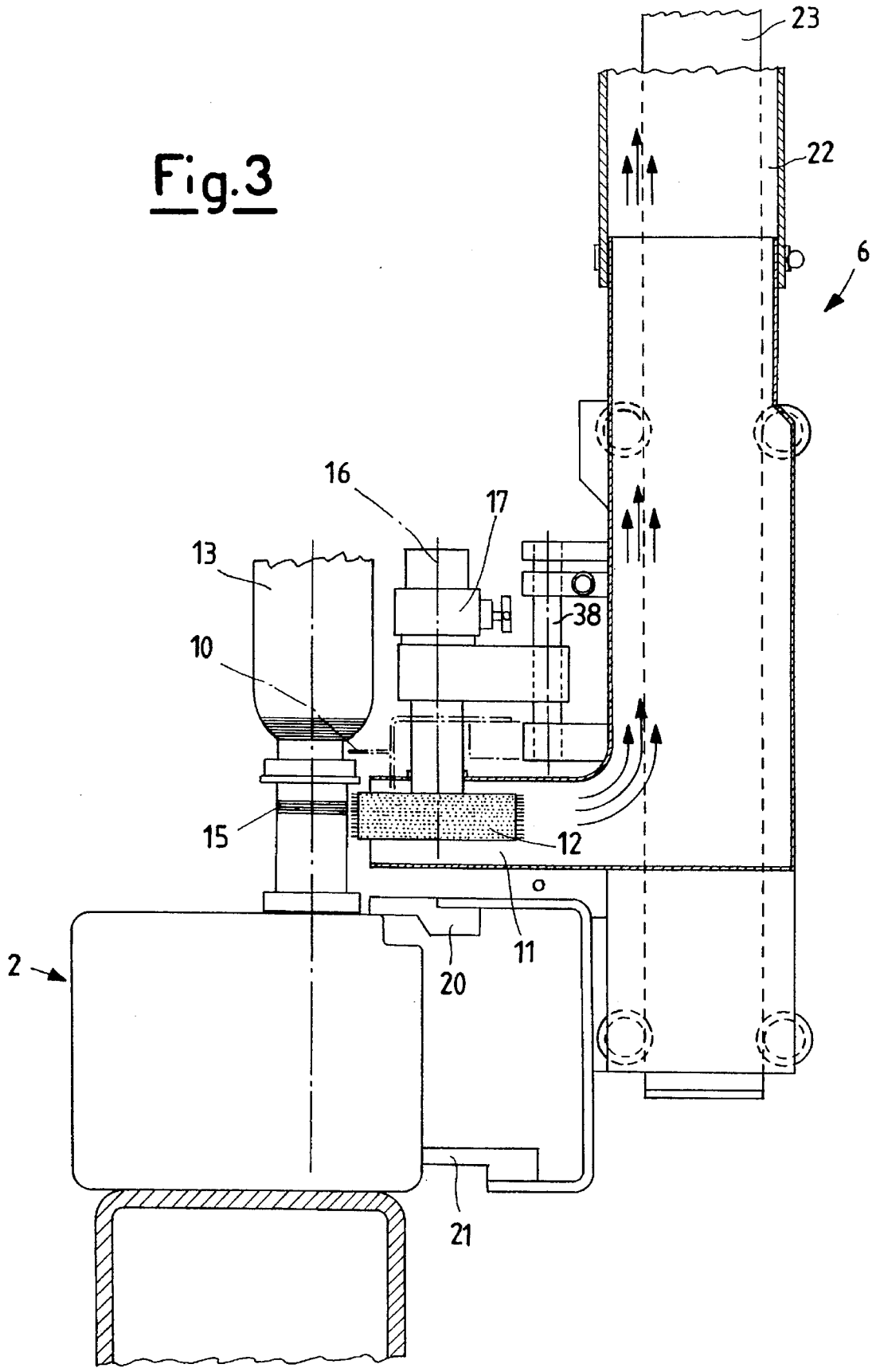
FIG. 3 is a side view of the unit according to the invention.
Figure 4:
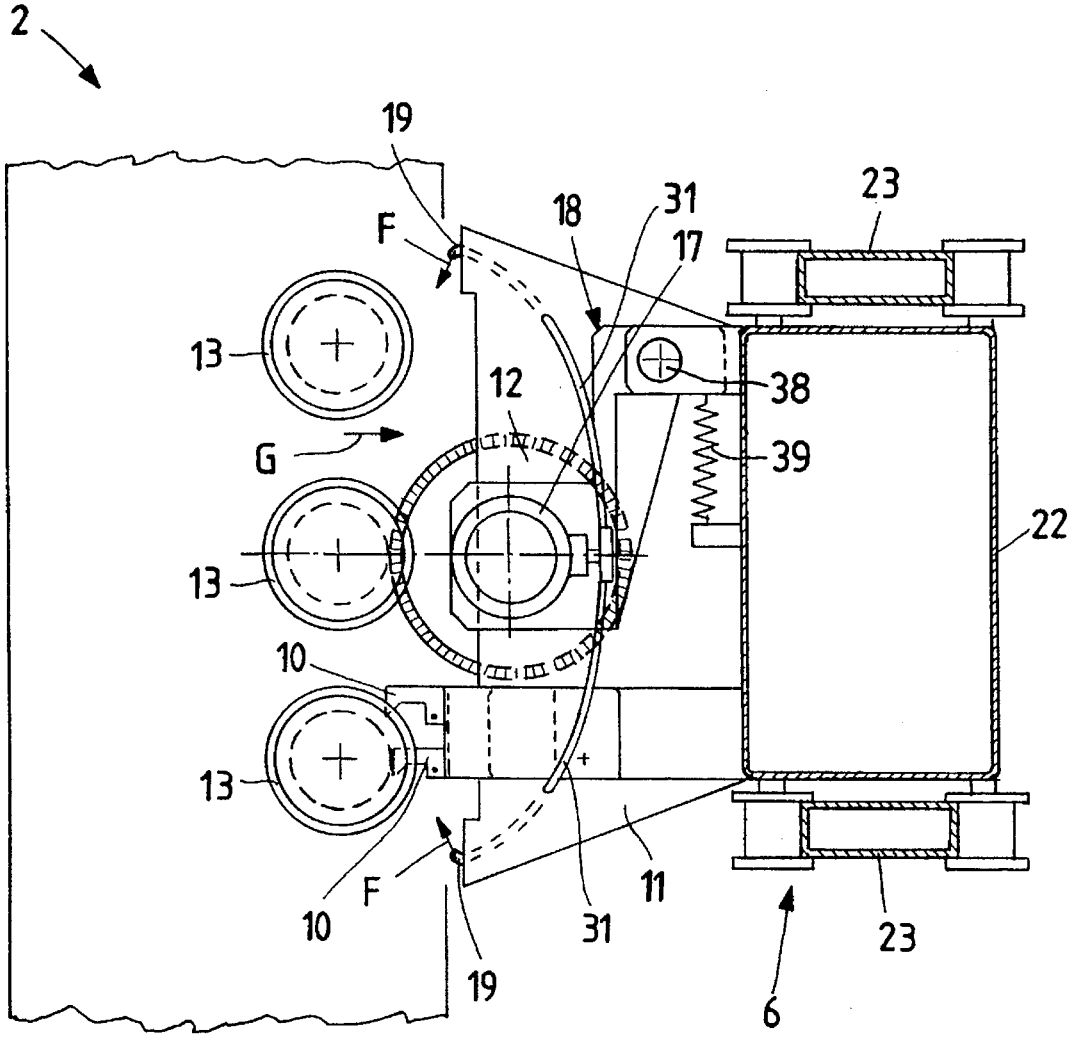
FIG. 4 is a plan view of the unit according to the invention.

The valve 25 is positioned in a branch 28 of a suction duct 29 of the travelling blower 4. It automatically opens when the end of the elbow 30 of the pipe 22 mounts the branch 28 as the pawl 26 engages the hook element 27. In contrast, it automatically closes when the travelling blower 4 and the unit 1B separate. The remaining components of the unit 1B are as shown in FIGS. 3 and 4 and consequently the aforegoing description is also valid for these.

During operation the unit 1B is dragged by the travelling blower 4, which also provides its suction. By means of the electrical circuit which controls the operation of both devices it is possible to set the number of travel strokes during which the travelling blower 4 drags the unit 1B.

As both units 1A and 1B are of the type which traverse on rails 3 positioned above and along the spinning or twisting machine 2, they do not occupy space adjacent to the textile machine 2, which hence remains at the total disposal of the operator manually operating on the spinning frame.

When inoperative, the unit 1A–1B remains parked at one of the two ends of the machine. Commencement of the operating cycle for the unit 1A–1B is automatic.

I claim:

1. A unit (1A, 1B) for removing yarn reserve (15) from spindles (13) of spinning or twisting machines (2) of the type traversing on rails (3) positioned above and along the spinning or twisting machine (2), said unit (1A, 1B) comprising means (10) for cutting a yarn portion interposed between that wound on the spindle (13) and that forming the yarn reserve (15), a brush (12) for removing said yarn reserve (15), a suction device (6) provided with a suction port (11) adjacent said blade (10) and brush (12), said brush (12) being circular in plan and being mounted for rotation about a vertical axis, and said brush (12) being housed partly within the suction port (11) and having a brush portion projecting beyond said suction port (11).

2. A unit as claimed in claim 1, characterised in that to a side of the suction port (11) there are positioned two mutually converging blow nozzles (19) directed towards the outside of said suction port (11) so as to blow air countercurrently to that drawn in by the suction port (11).

3. A unit as claimed in claim 2, characterised in that said blow nozzles (19) are fed by the exhaust air of a pneumatic motor (17) operating the rotary brush (12).

4. A unit as claimed in claim 1, characterised in that the rotational speed of the brush (12) is adjustable.

5. A unit as claimed in claim 1, characterised by a first (20) and a second (21) locator respectively operating to provide positioning, in both vertical and horizontal directions, between the spindles (13) and the cutting means (10), brush (12) and suction port (11).

6. A unit as claimed in claim 1, characterised by being simultaneously hookable/releasable mechanically and connectable/disconnectable pneumatically to and from a travelling blower (4) which provides suction to said suction device (6).

7. A unit as claimed in claim 6, characterised in that the unit (1A, 1B) is conveyed by said travelling blower (4) for a variable number of programmable travel strokes along the spinning or twisting machine.

8. A unit as claimed in claim 1, characterised in that the cutting means (10) is interposed between the yarn wound on the spindle (13) and the yarn forming the yarn reserve (15) and are a pair of blades (10).

9. The unit as defined in claim 1 including means for effecting pivoting movement of said brush (12) relative to said suction port (11).

10. The unit as defined in claim 1 including means for effecting pivoting movement of said brush (12) relative to said suction port (11), and means for biasing the brush (12) in at least one direction of its pivoting movement.

11. The unit as defined in claim 1 including means for effecting pivoting movement of said brush (12) relative to said suction port (11), and means for biasing the brush (12) in a direction outwardly of said suction port (11) toward an associated spindle (13).

12. The unit as defined in claim 1 including locator means (20 or 21) for guidingly positioning the movement of said brush (12) along said spindles (13).

13. The unit as defined in claim 1 wherein said pivot movement effecting means includes a generally vertical axis in substantially parallel relationship to an axis of each spindle (13) and an axis of rotation of said brush (12).

* * * * *